US012397221B2

(12) United States Patent
Spiegl

(10) Patent No.: US 12,397,221 B2
(45) Date of Patent: Aug. 26, 2025

(54) CONFIGURABLE MODULAR SKATE BLADE ASSEMBLY WITH IMPROVED DAMPING

(71) Applicant: BLADE SCIENCE S.R.O., Brno (CZ)

(72) Inventor: Ondrej Spiegl, Falun (SE)

(73) Assignee: BLADE SCIENCE S.R.O., Brno (CZ)

( * ) Notice: Subject to any disclaimer, the term of this patent is extended or adjusted under 35 U.S.C. 154(b) by 232 days.

(21) Appl. No.: 18/261,204

(22) PCT Filed: Jan. 12, 2022

(86) PCT No.: PCT/SE2022/050017

§ 371 (c)(1),
(2) Date: Jul. 12, 2023

(87) PCT Pub. No.: WO2022/154721

PCT Pub. Date: Jul. 21, 2022

(65) Prior Publication Data

US 2024/0066382 A1 Feb. 29, 2024

(30) Foreign Application Priority Data

Jan. 15, 2021 (SE) ..... 2150034-3

(51) Int. Cl.

| | |
|---|---|
| ***A63C 1/30*** | (2006.01) |
| ***A63C 1/24*** | (2006.01) |
| ***A63C 1/28*** | (2006.01) |
| ***A63C 1/32*** | (2006.01) |

(52) U.S. Cl.

CPC ..... *A63C 1/303* (2013.01); *A63C 1/24* (2013.01); *A63C 1/28* (2013.01); *A63C 1/32* (2013.01); *A63C 2203/20* (2013.01)

(58) Field of Classification Search

CPC .. A63C 1/303; A63C 1/24; A63C 1/28; A63C 1/32; A63C 2203/20; A63C 1/02

See application file for complete search history.

(56) References Cited

U.S. PATENT DOCUMENTS

| | | | | |
|---|---|---|---|---|
| 32,821 A * | 7/1861 | Corser et al. | ..... | A63C 1/24 280/11.14 |
| 1,111,246 A * | 9/1914 | Button | ..... | A63C 1/24 280/11.14 |
| 4,993,725 A | 2/1991 | Barnes et al. | | |
| 5,931,480 A | 8/1999 | Schroeder | | |

(Continued)

FOREIGN PATENT DOCUMENTS

| | | | | |
|---|---|---|---|---|
| CA | 2324724 C * | 2/2009 | ..... | A43B 13/182 |
| WO | WO-9528209 A1 * | 10/1995 | ..... | A63C 1/24 |

OTHER PUBLICATIONS

CA-2324724-C English Translation (Year: 2009).*

(Continued)

*Primary Examiner* — James A Shriver, II
*Assistant Examiner* — Michael T. Walsh
(74) *Attorney, Agent, or Firm* — NIXON & VANDERHYE

(57) ABSTRACT

Disclosed is a configurable modular damping ice-skating blade assembly including a frame with a blade runner extending along a longitudinal axis and being removably mounted in relation to the frame. The modular damping ice-skating blade assembly is configurable with the use of modified blade runners so as to allow one or more configurations for damping the frame in relation to the blade runner.

20 Claims, 14 Drawing Sheets

(56) References Cited

U.S. PATENT DOCUMENTS

| | | | | |
|---|---|---|---|---|
| 6,105,975 | A * | 8/2000 | Shum | A63C 1/32 280/11.12 |
| 7,905,501 | B2 * | 3/2011 | Landry | A63C 17/18 280/11.18 |
| 2008/0012248 | A1 | 1/2008 | Von Detten | |
| 2009/0056168 | A1 * | 3/2009 | Tseng | A43B 5/1658 36/107 |
| 2013/0285338 | A1 * | 10/2013 | Blois | A63C 1/30 29/446 |
| 2016/0001162 | A1 | 1/2016 | Azzolin et al. | |

OTHER PUBLICATIONS

WO-9528209-A1 English Translation (Year: 1995).*
International Search Report for PCT/SE2022/050017 mailed Jan. 21, 2022, 4 pages.
Written Opinion of the ISA for PCT/SE2022/050017 mailed Jan. 21, 2022, 4 pages.

* cited by examiner

CONFIGURABLE MODULAR SKATE BLADE ASSEMBLY WITH IMPROVED DAMPING

This application is the U.S. national phase of International Application No. PCT/SE2022/050017 filed Jan. 12, 2022, which designated the U.S. and claims priority to SE Patent Application No. 2150034-3 filed Jan. 15, 2021, the entire contents of each of which are hereby incorporated by reference.

TECHNICAL FIELD

The invention relates to a configurable modular damping ice-skating blade assembly comprising a frame with a blade runner extending along a longitudinal axis and being removably mounted in relation to the frame.

BACKGROUND

Ice-skating blades, such as for figure skating, ice hockey, speed skating or recreational skating, all evolved from common devices intended to glide on an ice surface for travel and transportation purposes, the first being made from animal bones. Ice-skating blades have ever since been improving in relation with advances in technology and material, and evolving in relation to individual ice sport disciplines. It is obvious that different ice-skating sports and disciplines require different modifications and features to the ice-skating blade. It is preferable to use cushioning equipment and shoe wear for sport activities comprising frequent landing impacts, for instance it is preferable to play basketball in basketball shoes with thick soft outsoles rather than in stiff ballet shoes. While figure skaters can benefit from having ice-skating blades with an integrated damping system, due to on-ice jumping elements, this would be of no benefit for speed skaters who on the other hand benefit from longer blade runners, resulting in increased skating speeds. Common figure skating blades are rigid in construction while some ice hockey blade models and "Klap" speed skating blade models are modified to allow some degree of blade runner movement in relation to the frame or boot, however not primarily intended for damping landing impacts from jumps on the ice.

Conceptually known landing damping ice-skating blades and inline skates enable one configuration of damping that occurs to a lesser extent in a single axis relative to the frame. US patent No. 2017/0028291—a blade arrangement comprising a support for an ice skate boot with a blade runner mounted to the support and a suspension structure arranged between the support and the blade runner.

U.S. Pat. No. 9,089,763—a skate boot appliance for absorbing impact force of landing skating maneuvers by disposing a plunger or displacement member in a receptacle in response to an impact force.

EP patent No. 2,123,334—inline skate having impact absorbing members, made of resilient material, inserted into insert grooves of the frame.

U.S. Pat. No. 9,943,748—a skate blade system wherein the blade portion is fastened at the heel end to a blade housing in a fixed relationship and is unattached from the blade portion blade housing at the toe end.

CA patent No. 2,324,724—ice skate with suspension, accomplished with either coil or leaf type spring, between the skate boot and the blade in a blade runner/holder housing.

U.S. Pat. No. 6,007,075—a skate of the clap type wherein the blade is pivotally movable with respect to the boot.

U.S. Pat. No. 4,993,725—a single blade ice skate formed as a unitary assembly from a flat sheet of metal, wherein the boot plates are bent into a U-shape, so as to provide a U-shaped vertical spring member operating in the vertical plane of the blade.

As figure skating has evolved from being oriented primarily on skating skills, modern figure skaters, soloists and pair skaters, spend significantly more time on practicing on-ice jump elements. A large number of landing repetitions and absorbing of high ground reaction forces is one of the contributing factors to an increased frequency of chronic overuse injuries in figure skaters over the last decades.

Landings from on-ice figure skating jumps are performed on a single leg backwards with glide away from the place of the impact in a curve. The landing has a toe to heel character and the ground reaction force vector is pointing upwards to different angles, shifting from an acute angle relative to a forward-rearward longitudinal axis of the blade runner at initial contact of the blade runner with the ice surface, to perpendicularly upwards pointing peak force when a skater stabilizes a landing position. The location of the loading on the blade runner is also shifting from the front section of the blade runner to the rear section.

SUMMARY

In accordance with the disclosure, there is provided an assembly having an object of providing an improved and configurable modular ice-skating blade assembly.

In accordance with an embodiment of the invention, this object is obtained by a configurable modular damping ice-skating blade assembly comprising a frame with a blade runner extending along a longitudinal axis and being removably mounted in relation to the frame. The modular damping ice-skating blade assembly is configurable with the use of modified blade runners so as to allow two or more configurations for damping the frame in relation to the blade runner.

In accordance with a further embodiment, the object is obtained by a blade assembly which is further configurable by means of at least one damping unit arranged in said frame, so as to allow one or more configurations for damping the frame in relation to the blade runner, wherein the damping unit is located between protruding arms of the frame, which are shaped to secure the damping unit in the forward-rearward longitudinal axis relative to the frame and, optionally, also to allow lateral displacements of the damping unit when a compressive load is transmitted to the damping unit.

An advantage with the assembly according to the disclosure is that it constitutes a modular ice-skating blade assembly with optional configurations enabling improved impact damping in two degrees of freedom (2DOF), where the blade runner dynamically interacts with the direction and the location of the ground reaction force vector during a landing impact, or in one degree of freedom (1DOF), where the blade runner is pivotally attached in the frame to allow damping of the vertical component of the ground reaction force that occurs in the rear section of the ice-skating blade assembly during a landing impact, wherein the damping unit in the modular ice-skating blade assembly is located between protruding arms of the frame that secure the damping unit in the forward-rearward longitudinal axis relative to the frame while allowing lateral displacements of the damping unit when a compressive load is transmitted to the damping unit during landing impacts and also to accommodate damping units of larger size which would be disadvantageous to encase with the frame, or a configuration where the blade runner and the frame creates a rigid construction with no damping.

According to an embodiment, the assembly may comprise at least one damping unit configured for providing damping of the movement of the frame in relation to the blade runner, and wherein said at least one damping unit is arranged in said frame with a configuration for allowing said blade runner to move in a flexible manner in said frame along the longitudinal axis and along a vertical axis which is perpendicular to said longitudinal axis, so as to provide damping in two degrees of freedom.

According to an embodiment, the assembly may comprise at least one damping unit configured for providing damping of the movement of the frame in relation to the blade runner, and where said blade runner is pivotally coupled in relation to said frame in a configuration to move in a flexible manner in said frame along an axis of rotation, which is transverse to said longitudinal axis, so as to provide damping in one degree of freedom.

According to an embodiment, the blade runner may be rigidly mounted in relation to said frame creating a rigid configuration with generally no damping.

According to an embodiment, the damping unit may have a curved longitudinal profile that enables the blade runner to be secured within the frame in the forward-rearward longitudinal axis and vertical axis relative to the frame.

According to an embodiment, the frame may comprise a front-frame unit and a back-frame unit and wherein a first damping unit is located between protruding arms in the front-frame unit and a second damping unit is located between protruding arms in the back-frame unit.

According to an embodiment, the contact between said blade runner and said damping unit may be via a supporting part.

According to an embodiment, the damping unit may be provided with a groove on its upper side to secure its position within the frame, said groove being configured to fit in a protrusion in said frame or the heads of fastening members that attaches said frame to the sole of a skate boot.

According to an embodiment, the damping unit may be provided with a protrusion extending from its top portion to secure its position within the frame, said protrusion being configured to fit in an aperture in said frame.

According to an embodiment, the damping unit may be configured as an elastic body with a cavity.

According to an embodiment, the damping unit may comprise an infill or a spring which is accommodated within said cavity in the elastic body, so as to reinforce the damping unit.

According to an embodiment, the damping unit and said infill may be made of elastomeric material of different A Shore hardness.

According to an embodiment, the blade runner may be provided with at least one large transversally extending aperture allowing the blade runner to be attached to said frame, or said blade runner may be provided with at least one large transversally extending aperture and one generally circular through-hole allowing the blade runner to be attached to said frame, said through-hole being is intended for the pivotal coupling with the frame, or said blade runner may be provided with at least two generally circular through-holes allowing the blade runner to be attached to said frame creating a rigid construction.

According to an embodiment, the blade runner may be attached to the frame by means of a transversal bearer extending through said large aperture or said circular through-hole.

According to an embodiment, the large transversally extending aperture may allow movement of the blade runner upwards to different angles in the forward-rearward longitudinal axis, the vertical axis and along an axis of rotation relative to the frame without interfering with the transversal bearer that passes through the large aperture.

According to an embodiment, the transversal bearer may be configured as a pin with a screw hole and a screw located in said screw hole, so as to create a counterforce mechanism enabling to adjust the fit and preloading force between the blade runner and the damping unit by means of screwing said screw from said pin against said blade runner which shifts said blade runner upwards in the direction of said damping unit.

According to an embodiment, a friction part or friction points may be used and configured to reduce the friction and to eliminate direct contact between the blade runner and the inside walls of the frame.

According to an embodiment, the frame may comprise bumpers extending downwards from a top inside wall of said frame and in line with the blade runner, and being configured for protecting the frame from possible impacts of the blade runner during its movement inside the frame.

According to an embodiment, the frame may constitute an integral part of a sole of an ice-skating boot.

According to an embodiment, damping units of different stiffnesses may be arranged for skaters of different weight categories, generally limited by the displacement of the damping unit being less than one millimeter under a load of two times the body weight of a skater.

According to an embodiment, the protruding arms of the frame may be joined to form an opening which can accommodate the damping unit.

According to an embodiment, the damping unit may be located between protruding arms of the frame, which are shaped to allow lateral displacements of the damping unit when a compressive load is transmitted to the damping unit.

According to an embodiment, the ice-skating blade assembly may comprise a frame with a blade runner extending along a longitudinal axis, wherein the frame comprises one or more protruding arms which are shaped to secure a damping unit in the forward-rearward longitudinal axis relative to the frame.

DETAILED DESCRIPTION

According to an embodiment, the invention provides a configurable modular damping ice-skating blade assembly for use with modified blade runners for optional configurations enabling a unique impact damping system in two degrees of freedom (2DOF), where a blade runner dynamically interacts with the direction and the location of the ground reaction force vector (GRFV) during a landing impact by moving in a frame upwards to different angles in a forward-rearward longitudinal axis and a vertical axis which is substantially perpendicular to the frame, against flexible damping units placed in the frame of the blade assembly, or in one degree of freedom (1DOF), where a modified blade runner is pivotally attached in the frame about an axis transverse to the forward-rearward longitudinal axis of the blade runner, against flexible damping units placed in the frame, to allow damping of the vertical component of the ground reaction force that occurs in the rear section of the blade assembly during a landing impact, but also a configuration where a modified blade runner and the frame of the blade assembly creates a rigid construction with no damping.

The present invention is described in the following examples, which may represent more than one embodiment of the present invention.

Figure 6:
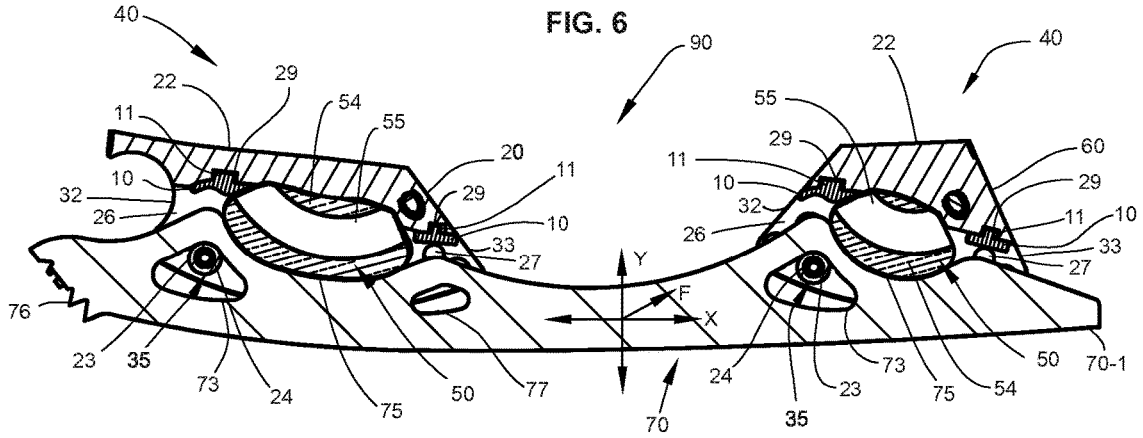
FIG. 6 is a cross-sectional view of the modular damping ice-skating blade assembly of FIG. 1 in configuration for improved impact damping in two degrees of freedom according to the first embodiment of the present invention.
Figure 7:
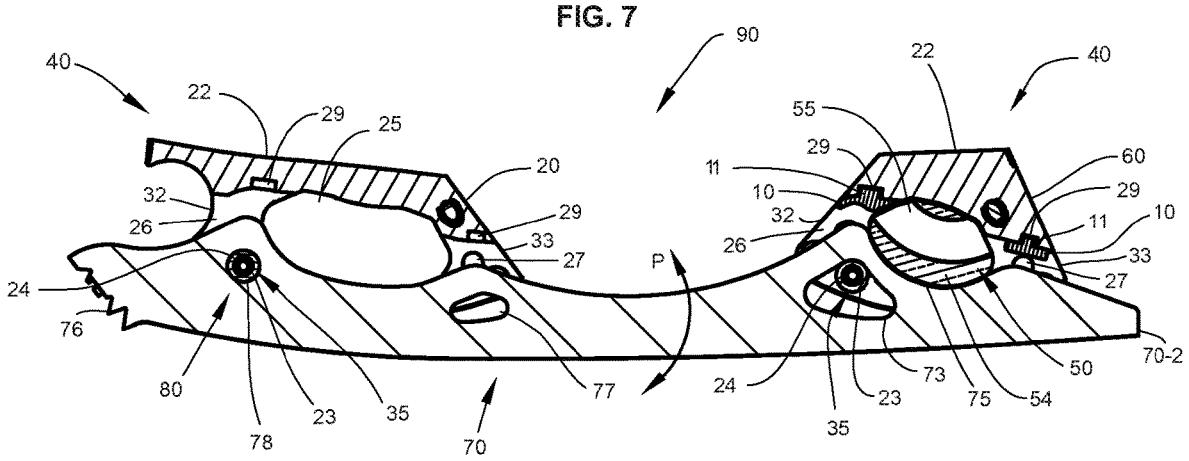
FIG. 7 is a cross-sectional view of an alternative configuration of the configurable modular damping ice-skating blade assembly of FIG. 1 in configuration for improved impact damping in one degree of freedom according to the first embodiment of the present invention.
Figure 8:
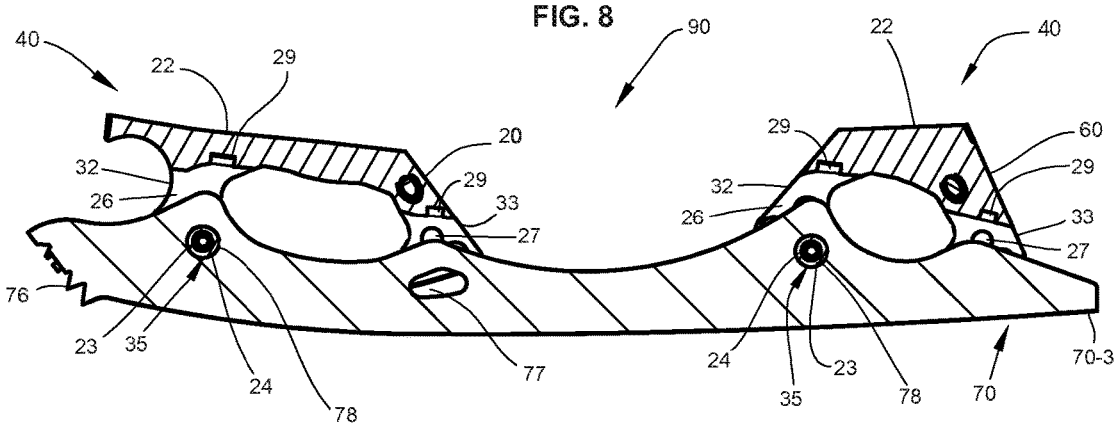
FIG. 8 is a cross-sectional view of an alternative configuration of the configurable modular damping ice-skating blade assembly of FIG. 1 in configuration for rigid construction with no damping according to the first embodiment of the present invention.
Figure 9:
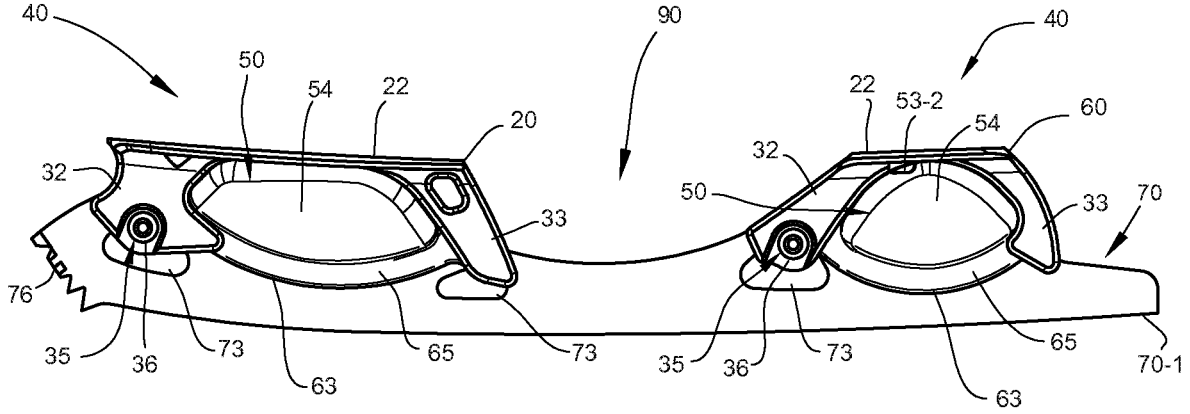
FIG. 9 is an elevational view of a further embodiment of the configurable modular damping ice-skating blade assembly shown in FIG. 1 in configuration for improved impact damping in two degrees of freedom.
Figure 10:
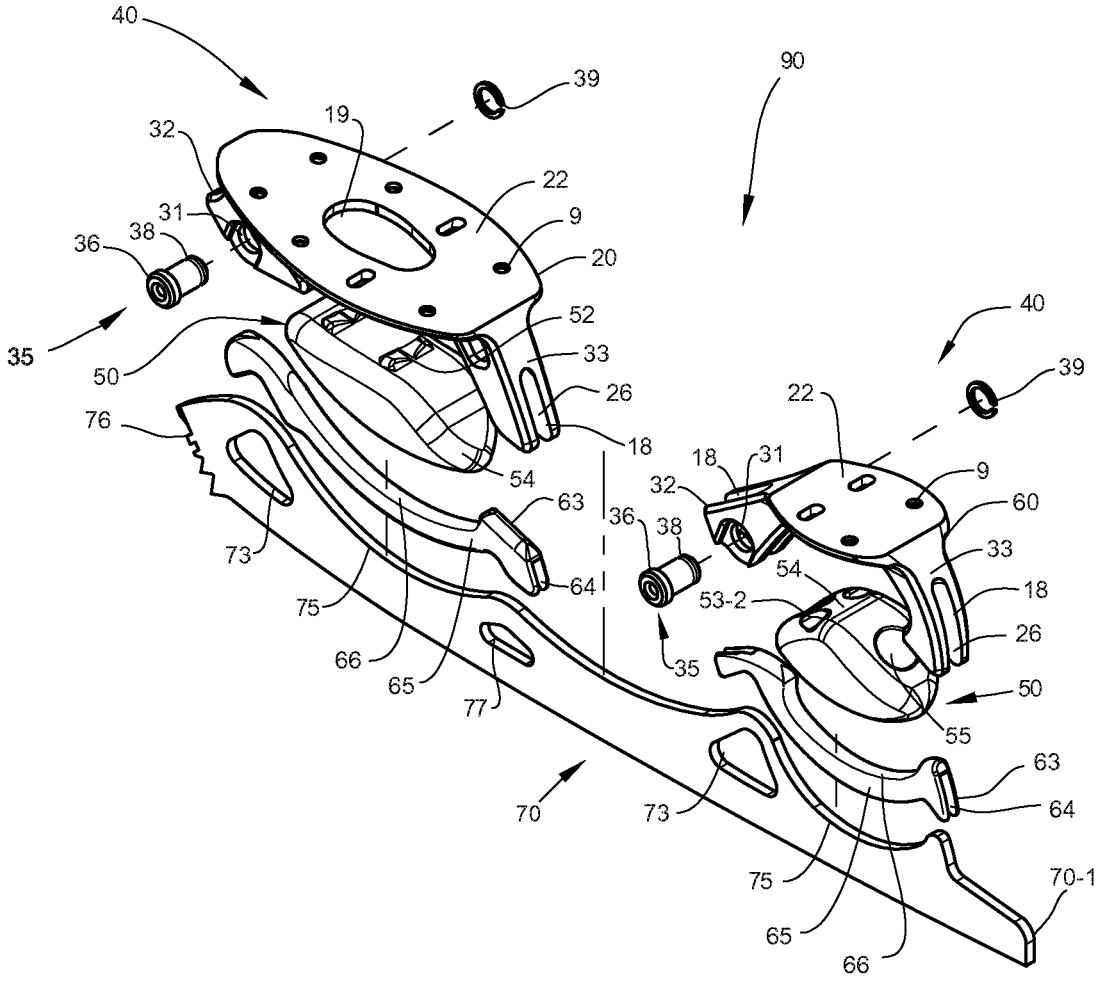
FIG. 10 is an exploded perspective view of the configurable modular damping ice-skating blade assembly shown in FIG. 9 in configuration for improved impact damping in two degrees of freedom according to the further embodiment of the present invention.
Figure 11:
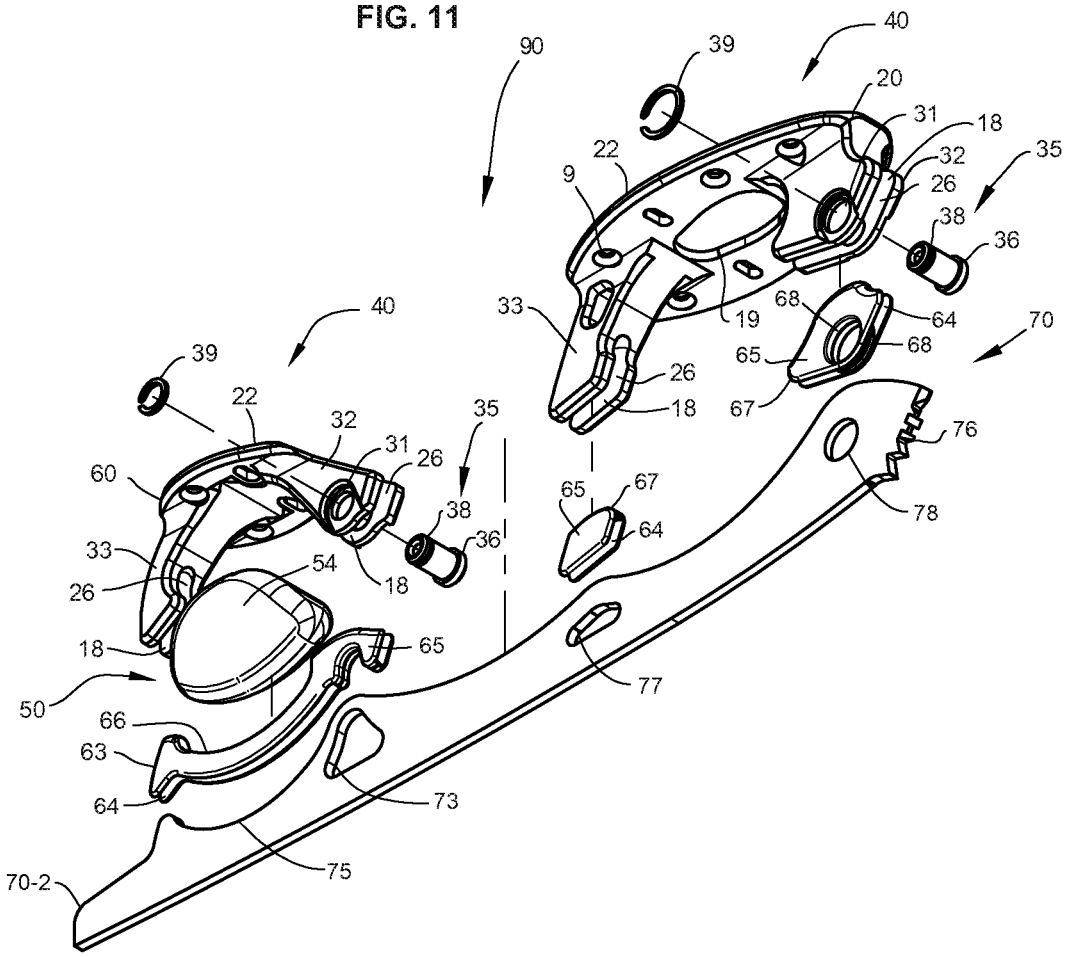
FIG. 11 is an exploded perspective view of an alternative configuration of the configurable modular damping ice-skating blade assembly shown in FIG. 9 in configuration for improved impact damping in one degree of freedom according to the further embodiment of the present invention.
Figure 12:
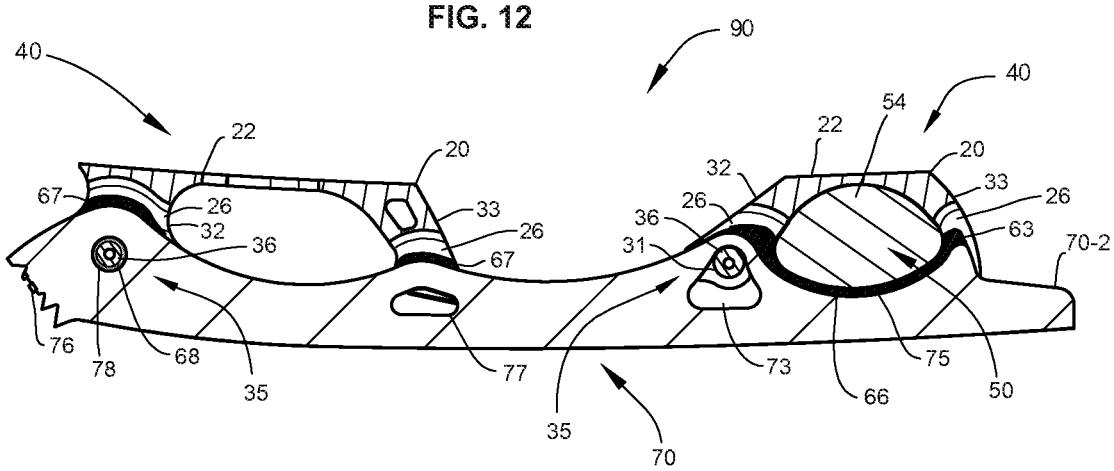
FIG. 12 is a cross-sectional view of the configurable modular damping ice-skating blade assembly shown in FIG. 11 in configuration for improved impact damping in one degree of freedom according to the further embodiment of the present invention.

Referring to the figures above, the present invention relates to a configurable modular damping ice-skating blade assembly 90 for use on a skate boot 100, which comprises a frame 40, part that is attached to the sole of the skate boot 100, a blade runner 70, part for gliding on an ice surface, and flexible damping units 50 to reduce landing impact loads, which are placed in the frame 40, where the modular damping ice-skating blade assembly 90 is configurable with the use of modified blade runners 70-1, 70-2 or 70-3 for damping in 2DOF and 1DOF, or a rigid construction with no damping. The blade runners 70-1, 70-2 or 70-3 are removably mounted to the frame 40, however the blade runners 70-1 or 70-2 are not rigidly attached to it, allowing slidable movement inside the frame 40, as shown in FIGS. 6-8. During a landing impact from a jump, the GRFV at initial contact of the blade runner 70 with an ice surface points upwards at an acute angle relative to the frame 40, along a reference axis (F), and perpendicularly upwards, along a reference axis (Y), when a skater stabilizes a landing position. The 2DOF damping configuration of the modular damping ice-skating blade assembly 90 includes the blade runner 70-1 with two large apertures 73 to allow for slidable movement of the blade runner 70-1 in the forward-rearward longitudinal axis (X) and the vertical axis (Y) inside the frame 40 against the damping units 50, as shown in FIGS. 1-4, 6, 9 and 10. The 1DOF damping configuration of the modular damping ice-skating blade assembly 90 includes the blade runner 70-2 with one large aperture 73 and one through-hole 78, generally of circular cut-out located in the front section of the blade runner 70-2, intended for pivotal coupling 80 with the frame 40, enabling pivotal slidable movement of the blade runner 70-2 in the axis of rotation (P), which is transverse to the longitudinal axis of the blade runner 70-2, inside the frame 40 against the damping units 50, generally one damping unit 50 placed in the rear section of the frame 40, as shown in FIGS. 7, 11 and 12. The configuration enabling the rigid construction of the modular damping ice-skating blade assembly 90 includes a blade runner 70-3 with two through-holes 78, generally of circular cut-out which does not permit an upward movement of the blade runner 70-3 inside the frame 40, generally one located in the front section and the other in the rear section of the blade runner 70-3, where such configuration of the modular damping ice-skating blade assembly 90 may not contain damping units 50, as shown in FIG. 8. In an alternative embodiment, the blade assembly 90 is not configurable and is set up for only one configuration, either for damping in 2DOF or 1DOF or a rigid construction without damping.

The damping units 50, that are placed in the frame 40 in the 2DOF and 1DOF damping configurations, support at least a portion of the top side of the blade runner 70-1 or 70-2, and secure the blade runner 70-1 or 70-2 in the forward-rearward longitudinal axis (X) and the vertical axis (Y) relative to the frame 40. In an alternative embodiment, the contact between the blade runner 70-1 or 70-2 and the damping unit 50 may be via a supporting part 63, as shown in FIG. 9-12. The frame 40 prevents the blade runner 70 from longitudinal bending, twisting, rotating and moving side-to-side in transversal axes relative to the frame 40 by covering at least a portion of the blade runner 70 from sides in transversal axes relative to the blade runner 70. The contact between the inside walls 26 of the frame 40 and the blade runner 70 is rather tight to prevent wobbling of the blade runner 70 inside the frame 40, but loose enough to allow for sliding movements of the blade runner 70-1 or 70-2 under high loads during landing impacts in the 2DOF and 1DOF damping configurations.

The blade runner 70 is placed inside the frame 40 and secured by a transversal bearer 35 that passes through the large aperture 73 or through-hole 78 in the blade runner 70. The large apertures 73 in the blade runner 70-1 and 70-2 must be of geometry and dimensions that will allow movement of the blade runner 70-1 and 70-2 inside the frame 40 without interfering with the transversal bearer 35, upwards to different angles in the forward-rearward longitudinal axis (X) and the vertical axis (Y) relative to the frame 40 in the 2DOF damping configuration using the blade runner 70-1, or pivotally upwards in the axis of rotation (P) relative to the pivotal coupling 80 generally located in the front section of the frame 40 in the 1DOF damping configuration using the blade runner 70-2, best shown in FIGS. 6 and 7. According to an embodiment, a gap must be left between the upper side of the blade runner 70 and the top inside surface of the frame 40 to allow for the upward movement of the blade runner 70-1 or 70-2 inside the frame 40, without interfering with the top inside surface of the frame 40. In the configuration where the blade runner 70-3 and the frame 40 creates a rigid construction, the transversal bearers 35 that passes through the through-holes 78 in the blade runner 70-3 are in tight contact with the through-holes 78 which does not permit any movement of the blade runner 70-3, best shown in FIG. 8.

The frame 40 comprise one or more protruding arms 32 and 33, directed downwardly from mounting plates 22 towards the blade runner 70, which are advantageously shaped to install and secure the damping unit 50 in the forward-rearward longitudinal axis (X) relative to the frame 40 against excessive movements in the assembly 90 or collisions with the blade runner 70 located on the skater's second leg, which may occur during skating movements, while allowing lateral displacements of the damping unit 50, best shown in FIGS. 1, 2 and 9-12. When the damping unit 50 is inserted into the frame 40, it is supported by the frame 40 from its upper side. However, the frame 40 of the modular damping ice-skating blade assembly 90 is not encasing the damping unit 50 laterally from the sides in transversal axis relative to the damping unit 50 and a gap is left between the front and rear portions of the damping unit 50 and the protruding arms 32 and 33. This way, the frame 40 does not interfere with lateral displacements of the damping unit 50 which occur due to its flexible nature, when a compressive load is being transmitted from the blade runner 70-1 or 70-2 to the damping unit 50 during landing impacts, and also accommodates damping unit 50 of larger sizes which would be disadvantageous to encase with the frame 40 as it would increase the weight of the assembly. It should now be clear that the phrase "install and secure" is used to define that the damping unit 50 is accommodated between the protruding arms 32, 33 in a manner in which it may or may not be in contact with either one, or both, of said protruding arms 32, 33. In an alternative embodiment, the damping unit 50 may be partially covered laterally from sides or be in tight contact with the protruding arms 32 and 33, such as in the case of securing the damping unit 50 within the frame 40, without dramatically affecting the lateral displacements of the damping unit 50 during compressive loading. In an alternative embodiment, the damping unit 50 may extend into a slot 18 in the protruding arms 32 and 33 to further secure its position within the frame or to provide further damping. The protruding arms 32 and 33 may be joined to form an opening 25 shaped to conform to the longitudinal profile of the damping unit 50, best show in FIG. 2. The greater the load the greater the displacement of the damping unit 50. In the 2DOF damping configuration, the load can be equally distributed by the blade runner 70-1 to all damping units 50 in the frame 40, such as during upright stands on the ice, or any of the damping units 50 placed in the frame 40 can be exposed to a larger portion of the load than the other, such as during spins or take-offs where the load is generally situated in the front part of the blade runner 70.

—Frame—

Figure 1:
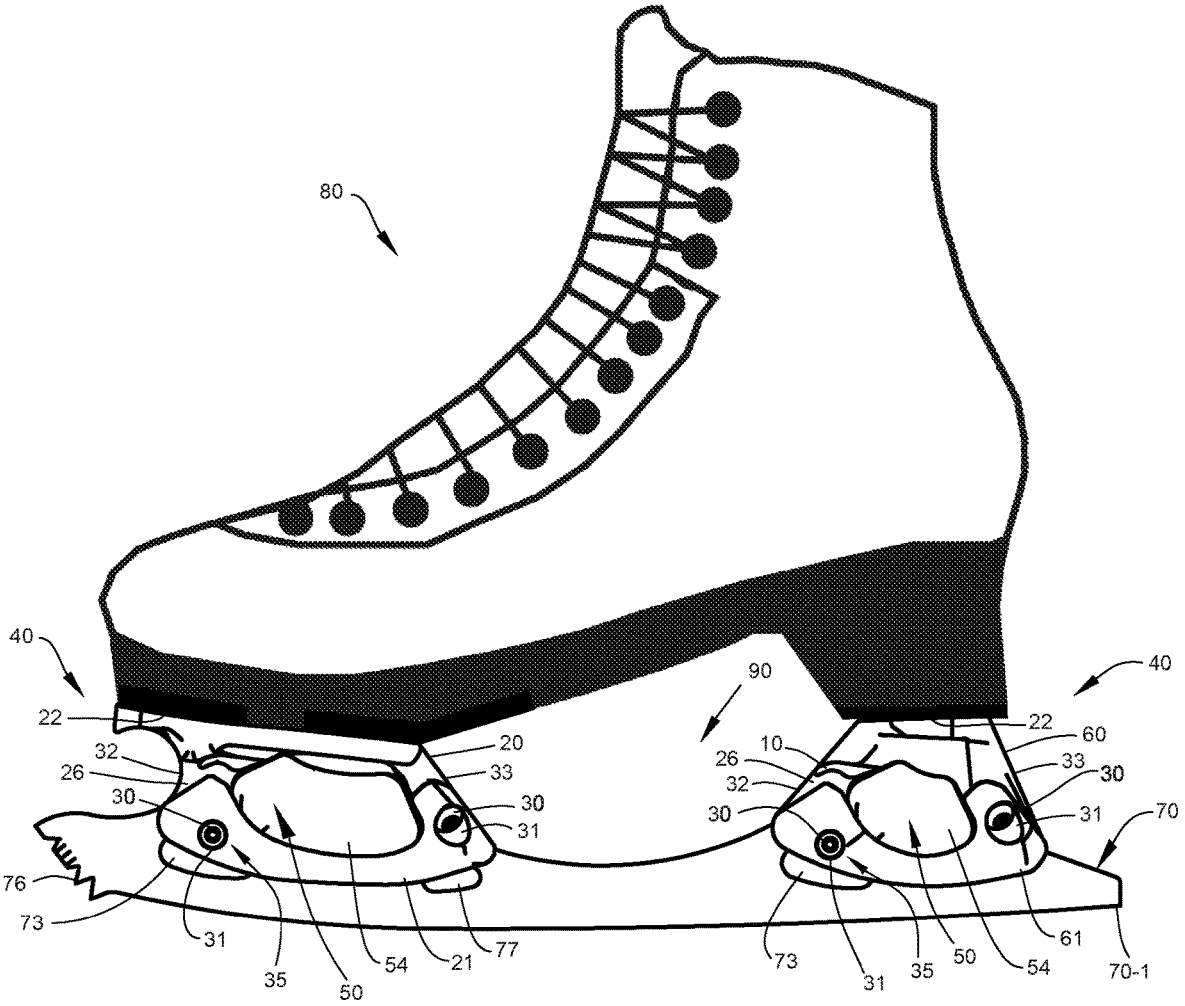
FIG. 1 is an elevational view of a modular damping ice-skating blade assembly in configuration for improved impact damping in two degrees of freedom in use on a skate boot according to a first embodiment of the present invention.

As presented in FIG. 1, the frame 40 generally consists of mounting plates 22 for attaching to the forward and heel portions of the sole of the skate boot 100 by using various fastening members, such as but not limited to screws or rivets. The mounting plates 22, typically planar surfaces, include a plurality of holes 9 for fastening members, best shown in FIGS. 2-4. In an alternative embodiment, the frame 40 may be an integral part of the sole of the skate boot 100, lowering the weight of the complex by excluding the mounting plates 22 and the need for fastening members for attaching the frame 40 to the sole of the skate boot 100.

The frame 40 of the modular damping ice-skating blade assembly 90, in this example as shown in the drawings, is divided into a front-frame 20 spaced from back-frame 60. In an alternative embodiment, the frame 40 may be composed from a different number of separated frames or composed of a single-piece frame. The front-frame 20 and back-frame 60 may include side frames, front-side-frame 21 and back-side-frame 61, according to an embodiment best shown in FIGS. 1-4. In an alternative embodiment, the frame 40 may include a different number of side frames. The front-side-frame 21 and back-side-frame 61 are connected to the respective front-frame 20 and back-frame 60 by one or more fastening members, in this example screws 30 each passing through one frame hole 31 of the side frames 21 and 61. The frames 20 and 60 in connection with the side frames 21 and 61 cover at least a portion of the blade runner 70 from both sides in transversal axis relative to the blade runner 70, to prevent the blade runner 70 from longitudinal bending, twisting, rotating and moving side-to-side in transversal axes relative to the frame 40. In an alternative embodiment, the frame 40 does not include a side frame, as shown in FIGS. 9-11, and at least a portion of the blade runner 70 is secured in the slot 18 in the protruding arms 32 and 33 from both sides in transversal axes relative to the blade runner 70, best shown in FIGS. 10 and 11.

The frame 40 is formed of a stiff, lightweight material such as, but not limited to, aluminum, titanium, polymer material or composite materials. The frame 40, as presented in FIGS. 1-4 and 6-8, is 3D printed from Nylon 12. The construction of the frame 40, being 3D printed from Nylon 12, is able to withstand the high loads that occur on the ice during skating, spinning and jumping. The frame 40, as presented in FIGS. 9-12, is CNC machined from aluminum. The entire assembly 90, in this example, comprising the frame 40, the damping units 50 and the blade runner 70 weighs less than a conventional figure skating blade (not shown) of corresponding size made of stainless steel or carbon steel.

Figure 2:
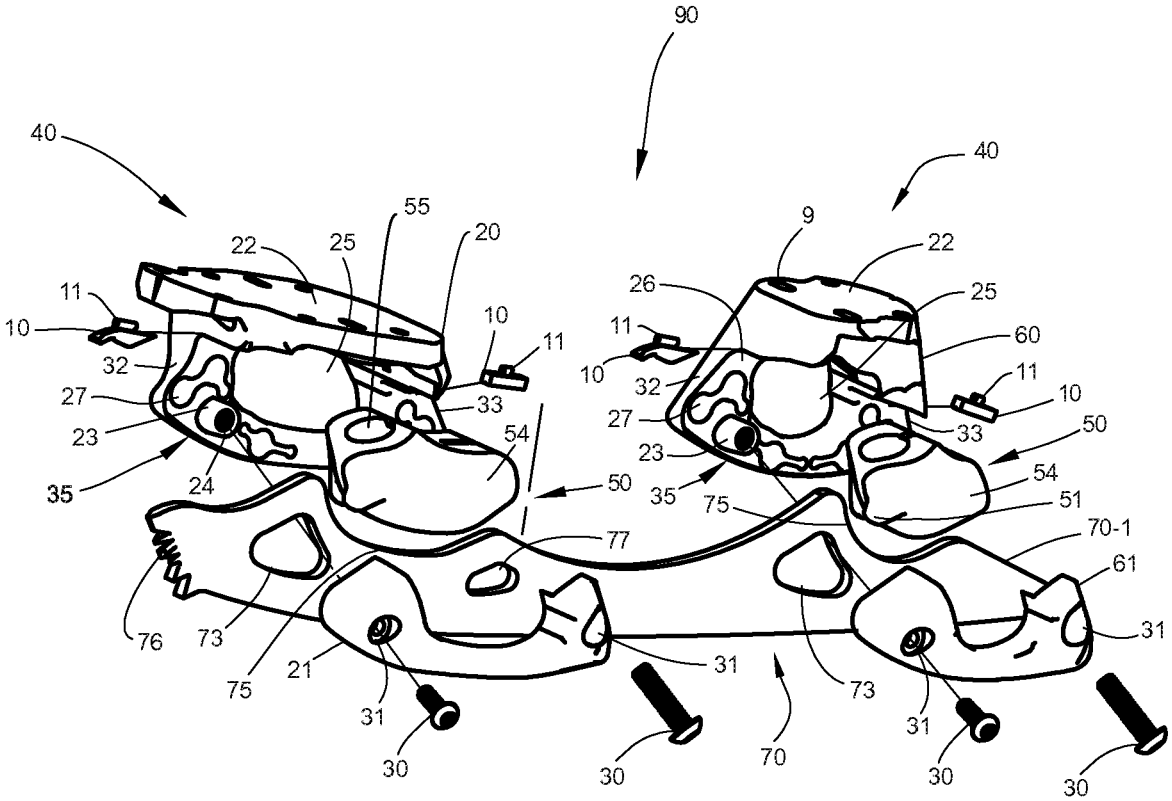
FIG. 2 is an exploded perspective view of the configurable modular damping ice-skating blade assembly of FIG. 1 in configuration for improved impact damping in two degrees of freedom according to the first embodiment of the present invention.
Figure 3:
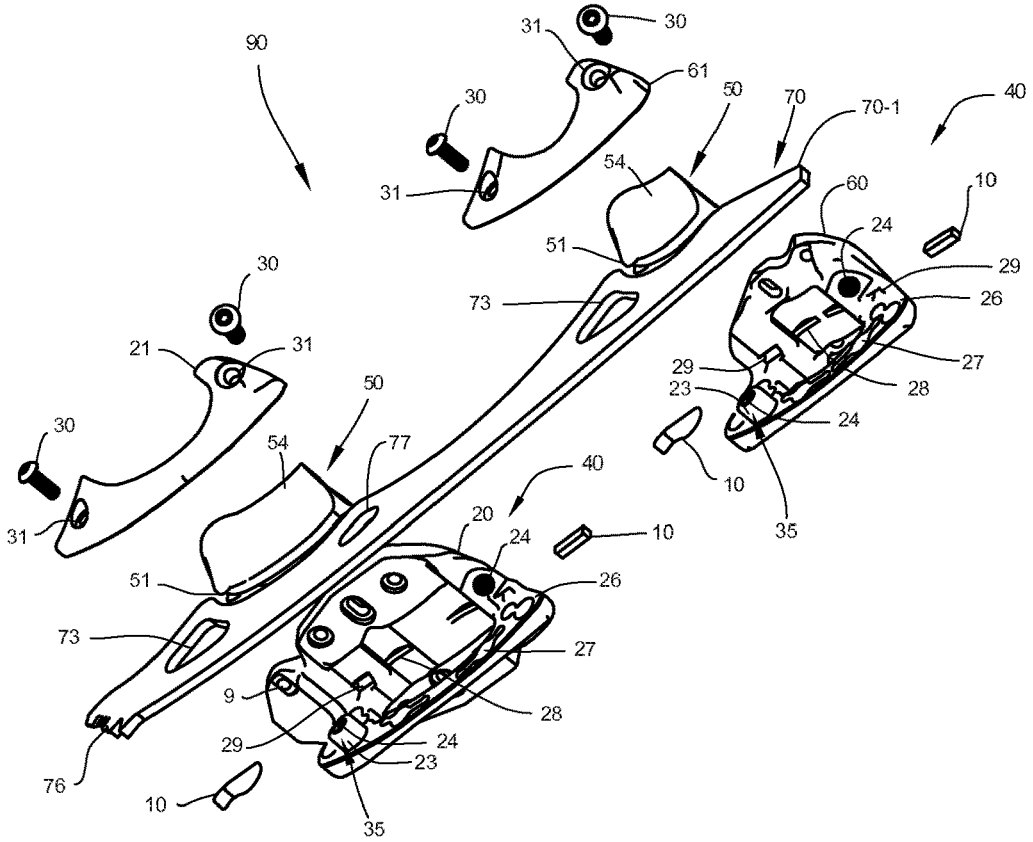
FIG. 3 is a further exploded perspective view of the configurable modular damping ice-skating blade assembly of FIG. 1 in configuration for improved impact damping in two degrees of freedom according to the first embodiment of the present invention, as regarded from slightly different angles as compared with the figures mentioned above.
Figure 4:
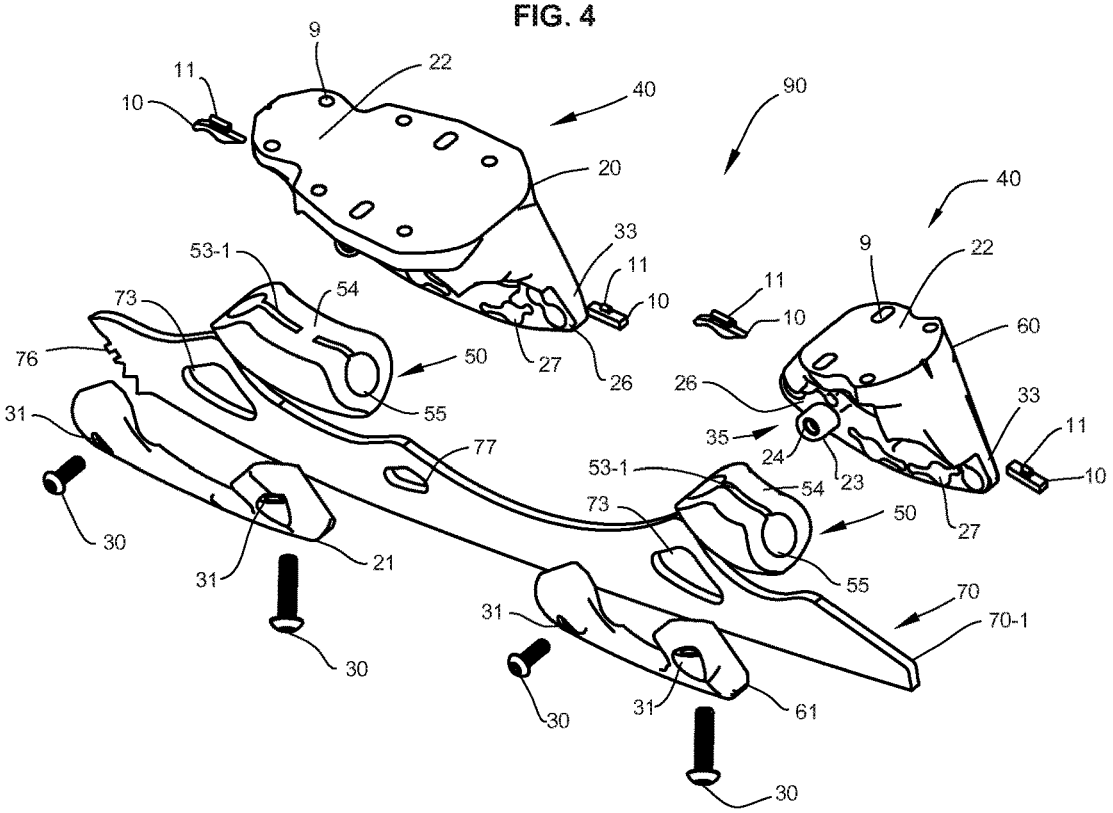
FIG. 4 is a further exploded perspective view of the configurable modular damping ice-skating blade assembly of FIG. 1 in configuration for improved impact damping in two degrees of freedom according to the first embodiment of the present invention, as regarded from slightly different angles as compared with the figures mentioned above.
Figure 14A:
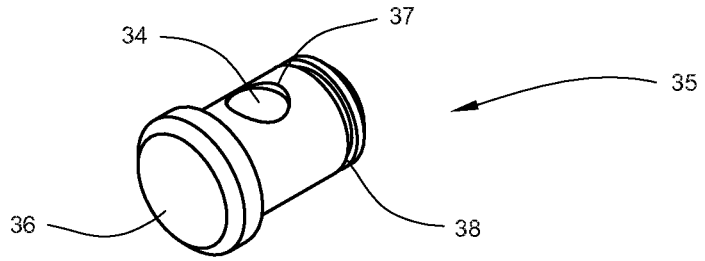
FIG. 14A is a perspective view of an alternative embodiment of the pin shown in FIG. 10 in configuration with a screw.
Figure 14B:
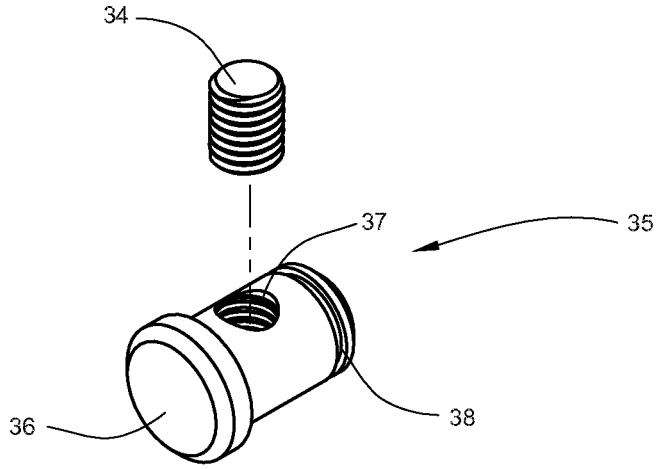
FIG. 14B is an exploded perspective view of the pin with the screw shown in FIG. 14A.
Figure 14C:
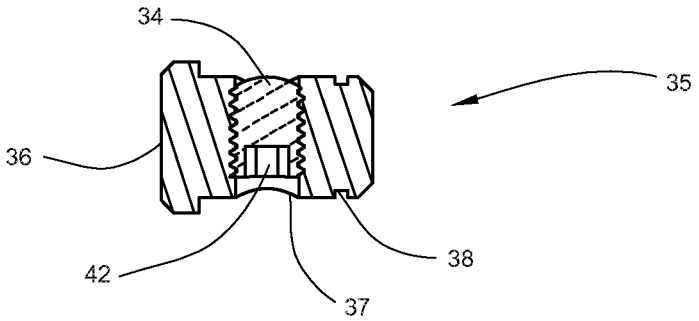
FIG. 14C is a cross-sectional view of the pin with the screw shown in FIG. 14A.

The transversal bearer 35 that holds the blade runner 70 within the frame 40 may be in the form of various fastening members, generally of cylindrical shape made of stiff material such as, although it is not limited to, aluminum, titanium, stainless steel, carbon steel or composite materials. The transversal bearer 35 may be an integral part of the frame 40. According to the first embodiment of the invention, the transversal bearer 35 that holds the blade runner 70 within the frame 40 has a form of a projecting portion 23 of cylindrical shape extending from the inside wall 26 of the frames 20 and 60, located in the front bottom sections of the frames 20 and 60, best shown in FIGS. 2-4. In an alternative embodiment, the frame 40 may include a different number of projecting portions 23, in different sections of the frame 40. The projecting portions 23 are extending to a distance enabling to mount the blade runner 70 to the frame 40, in this example 4 mm. The projecting portions 23 may include a thread 24 for attaching the screws 30 passing through the frame hole 31 of the side frames 21 and 61, as shown in FIG. 2-4. The projecting portions 23 may extend to fit into the side frames 21 and 61. In an alternative embodiment shown in FIGS. 6 and 7, the transversal bearer 35 may be a pin 36 with a groove 38 that can pass through the frame hole 31 located in one or both of the protruding arms 32 and 33 of the front and back-frame 20 and 60, and the large apertures 73 or through-holes 78 of the blade runner 70 securing it within the frame 40. Once the pin 36 is installed, it is secured on the other side of the frame 40 by a retaining ring 39 that fits into the groove 38 of the pin 36, preventing it from being pulled out from the frame 40. In an alternative embodiment shown in FIGS. 14A-14C, the transversal bearer 35, such as the pin 36 in this example, is constructed with a screw hole 37, passing vertically along the (Y) axis through the centre of the pin 36, adapted to receive a screw 34. The screw 34 is of a length that fits completely inside the pin 36, so that the pin 36 with the screw 34 can easily pass through the frame hole 31 for installation in the frame 40. The pin 36 with the screw 34 is of use in the 2DOF and 1DOF damping configurations of the modular damping ice-skating blade assembly 90, when using the blade runner 70-1 or 70-2 with the large apertures 73. While the pin 36 remains in fixed position relative to the frame 40, the screw 34 can be screwed upwards in vertical axis (Y) against the blade runner 70-1 or 70-2 that sits with the top inside surface of the large aperture 73 on the top of the pin 36 when the blade runner 70-1 or 70-2 is installed to the frame 40. When the screw 34 is in use and screwed upwards then the blade runner 70-1 or 70-2 is no longer in contact with the top of the pin 36, but instead with the top of the screw 34. The pin 36 with the screw 34 thus creates a mechanism enabling to adjust the fit between blade runner 70-1 or 70-2 and the damping unit 50 as well as adjusting the preloading force on the damping unit 50 by shifting the blade runner 70-1 or 70-2 upwards in the direction of the damping unit 50. The position of the screw 34 in the pin 36 can be adjusted by accessing the hex or slot recess 42 in the lower part of the screw 34 with a fitting key (not shown) via the large aperture 73 in the blade runner 70-1 or 70-2.

According to the first embodiment of the invention, the inside walls 26 of the frame 40 may be equipped with friction points 27 extending from the inside walls 26 up to several millimeters to reduce the contact area and friction between the blade runner 70 and the frame 40 upon the sliding movement of the blade runner 70 inside the frame 40 during the damping, best shown in FIGS. 2-4. The friction points 27, in this example, are an integral part of the frame 40, extending 0.5 millimeters from the inside walls 26 of the frame 40. In an alternative embodiment, a friction part 67 made of material with low coefficient of friction is used to eliminate direct contact between the blade runner 70 and the frame 40 as well as to reduce the contact area and friction, as shown in FIGS. 11 and 12. In an alternative embodiment, the supporting part 63 placed between the blade runner 70 and the damping unit 50, preferably made of material with low coefficient of friction, in this case made of Nylon 12, may also serve to reduce the friction during the sliding movement of the blade runner 70 inside the frame 40, shown in FIGS. 9-12. In this example, the supporting part 63 and the friction part 67 both comprise a slot 64 to sit tight on the top portion of the blade runner 70, covering the blade runner 70 from sides in transversal axes relative to the blade runner 70, in the contact areas with the inside walls 26 of the frame 40. The outside walls 65 of the supporting part 63 and the friction part 67 are in tight contact with the inside walls 26 of the frame 40, however sliding movements under high loads during landing impacts are made possible.

In the 1DOF damping configuration of the modular damping ice-skating blade assembly 90, a bushing 68 may be included in the through-hole 78 for the pivotal coupling 80, to lower the friction and wear between the blade runner 70-2 and the transversal bearer 35. The bushing 68 may be an integral part of the friction part 67, that projects from either side of the inside walls of the slot 64 into the through-hole 78 of the blade runner 70-2, as shown in FIGS. 11 and 12.

—Blade Runner—

Figure 5A:
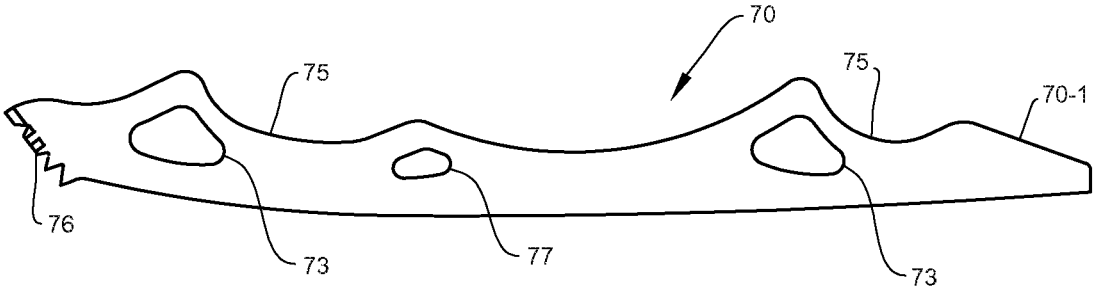
FIG. 5A is an elevational view of a blade runner shown in FIG. 1 configured for improved impact damping in two degrees of freedom according to the first embodiment of the present invention.
Figure 5B:
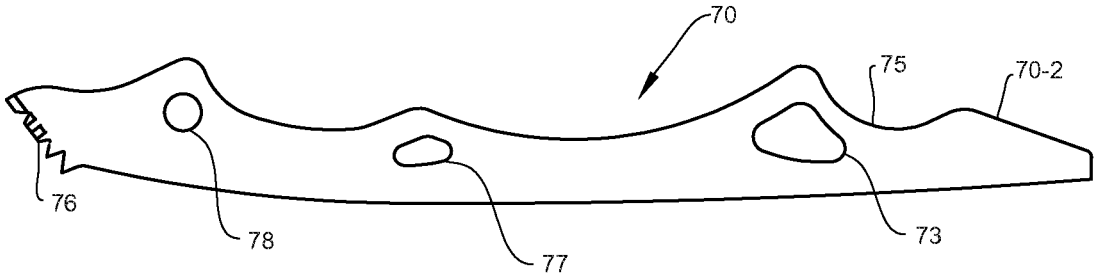
FIG. 5B is an elevational view of an alternative configuration of the blade runner shown in FIG. 5A configured for improved impact damping in one degree of freedom according to the first embodiment of the present invention.
Figure 5C:
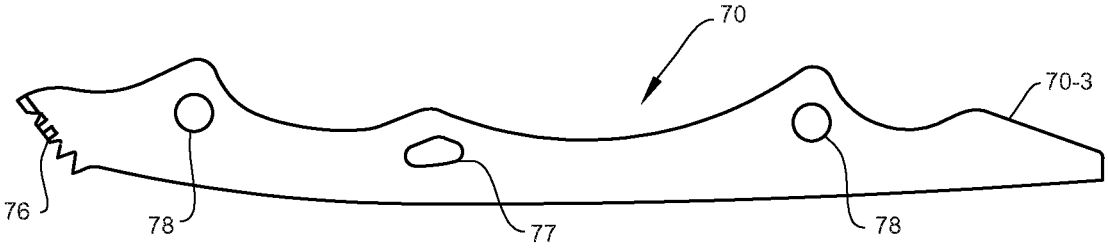
FIG. 5C is an elevational view of an alternative configuration of the blade runner shown in FIG. 5A configured for rigid construction with no damping according to the first embodiment of the present invention.

The blade runner 70 is generally an elongated part whose bottom portion is in contact with an ice surface during skating. The blade runner 70 is typically made of, although it is not limited to, stainless steel or high carbon steel. The front portion of the blade runner 70 has an angled front surface which has a plurality of teeth 76 projecting from it. The teeth 76 are the first portion of the blade runner 70 to contact an ice surface during a landing impact from a jump on the ice. The blade runner 70 modified for damping in 2DOF 70-1, 1DOF 70-2 and for rigid construction 70-3 is best shown in FIGS. 5A-5C. The upper portion of the blade runner 70 where it is to be in contact with the damping unit 50, possibly via the supporting part 63, has advantageously shaped profile 75 matching the longitudinal profile of the damping unit 50, in this case the blade runners 70-1 or 70-2. The contact between the blade runner 70 and the damping unit 50 does not have to be along the entire length of the damping unit 50. The blade runner 70 may include one or more cut-out pieces 77 intended to lower the weight of the blade runner 70.

In this example, depending on the configuration, the blade runners 70-1 and 70-2 are constructed with large apertures 73, through which passes the transversal bearer 35 for mounting in the frame 40, and which further enable a slidable movement of the blade runner 70-1 and 70-2 inside the frame 40. In an alternative embodiment, the blade runner 70 is constructed with hooks instead of the large apertures 73, extending from the top portion of the blade runner 70 enabling mounting to the transversal bearer 35 by hooking to it. In an alternative embodiment, the blade runner 70 is constructed with a combination of hook and the large aperture 73. It can be seen that the position of the large apertures 73 or the through-holes 78 in the blade runner 70 corresponds with the intended location of the transversal bearer 35 in the frame 40. When the blade runner 70 is installed to the frame 40, the top surface of the transversal bearer 35 and the top inside surface of the large aperture 73 in the blade runner 70-1 and 70-2 are aligned and in contact. In this example, the apertures 73 in the blade runner 70-1 and 70-2 are of a triangular shape. The large apertures 73 in the blade runner 70-1 and 70-2, in this example, allow the blade runner 70-1 and 70-2 to move upwards up to 7 millimeters inside the frame 40. In the 2DOF damping configuration, the large apertures 73 in the blade runner 70-1 enable movement upwards in a range of 104° degrees angle in the forward-rearward longitudinal axis (X) relative to frame 40 without interfering with the transversal bearer 35. In the 2DOF damping configuration, the connection places of the blade runner 70-1 and the transversal bearer 35 in the frame 40 may also act as pivoting points to further improve the damping interaction between the blade runner 70-1 and the location of the loading on the blade runner 70-1 during a landing impact.

—Damping Unit—

In the 1DOF damping configuration, according to an embodiment of the invention, generally one damping unit 50 is placed in the rear section of the frame 40, supporting at least a portion of the top side of the blade runner 70-2, possibly via a supporting part 63. In an alternative embodiment, two damping units 50 may be used in the 1DOF damping configuration, same as is presented in the 2DOF damping configuration. In the 2DOF damping configuration, according to an embodiment of the invention, generally one damping unit 50 is placed in the front section of the frame 40 and one in the rear section of the frame 40, together supporting at least a portion of the top side of the blade runner 70-1, possibly via the supporting part 63. The damping units 50, placed in the front and the rear section of the frame 40, may be of different longitudinal length, best shown in FIGS. 9, 10, 13E and 13D. The front section of the frame 40 generally accommodates a more elongated damping unit 50 compared to the rear section of the frame 40. In general, different frame 40 sizes will accommodate damping units 50 of different sizes and lengths. A damping unit 50 of larger size will accommodate a greater range of damping motion for the blade runner 70-1 or 70-2. If more damping units 50 are placed in the frame 40, they may be connected to each other by any kind of linkage. According to a further embodiment, one single damping unit 50 can be used for 2DOF damping configuration. In such case the damping unit 50 would be centered in the modular damping ice-skating blade assembly 90. In such a configuration, the damping unit would suitably be elongated all the way from the front aperture 73 or through-hole 78 to the rear aperture 73 of the blade runner 70-1 or 70-2, i.e., taking into account the position of the apertures 73 and through-hole 78 in the enclosed drawings.

Figure 13A:
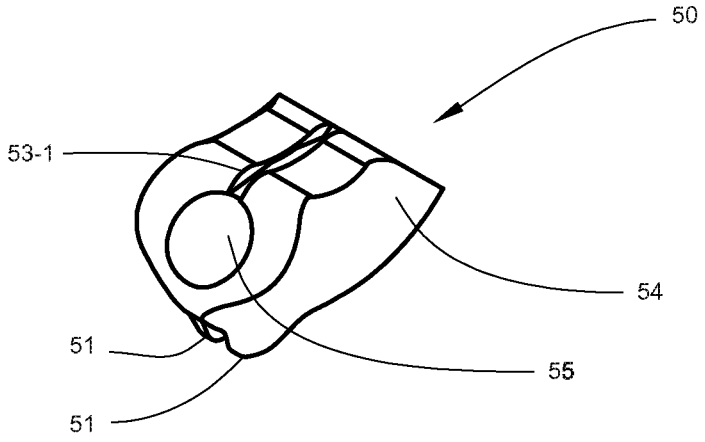
FIG. 13A is a perspective view of a damping unit shown in FIG. 1 according to the first embodiment of the present invention.
Figure 13B:
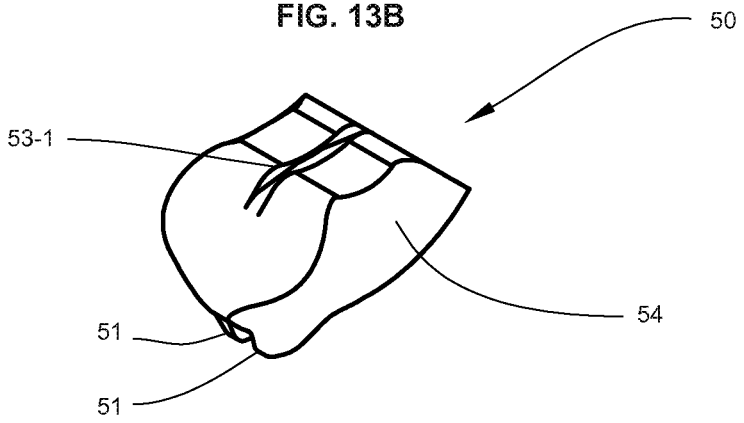
FIG. 13B is a perspective view of an alternative configuration of the damping unit shown in FIG. 13A according to the first embodiment of the present invention.
Figure 13C:
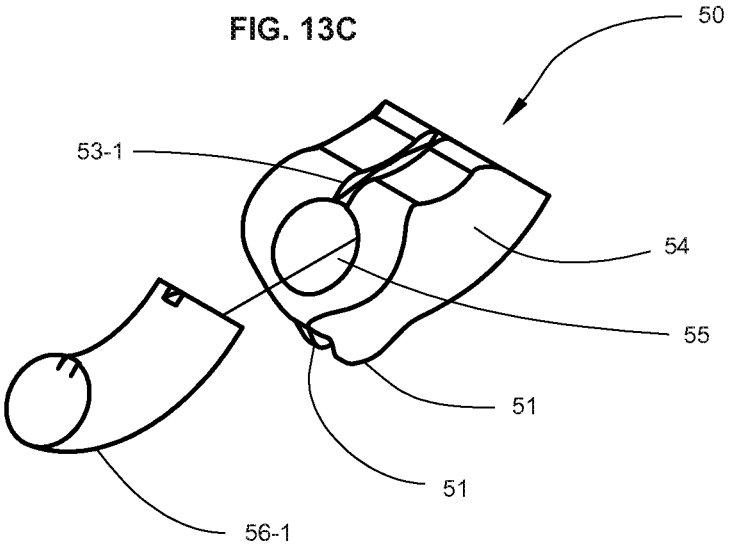
FIG. 13C is an exploded perspective view of an alternative configuration of the damping unit shown in FIG. 13A according to the first embodiment of the present invention.
Figure 13D:
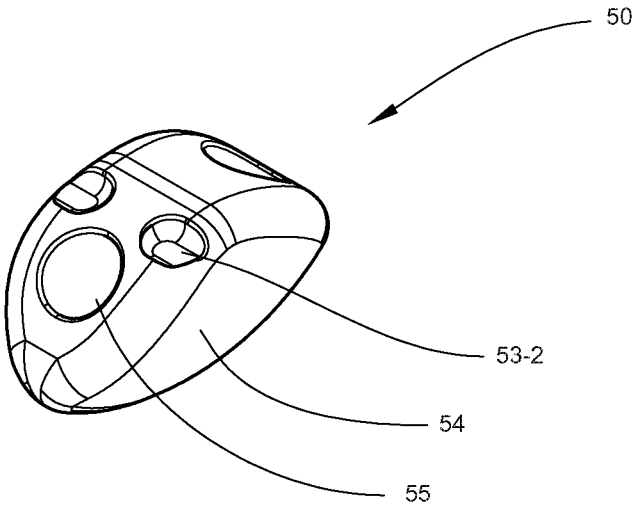
FIG. 13D is a perspective view of a further embodiment of a damping unit shown in FIG. 13A.
Figure 13E:
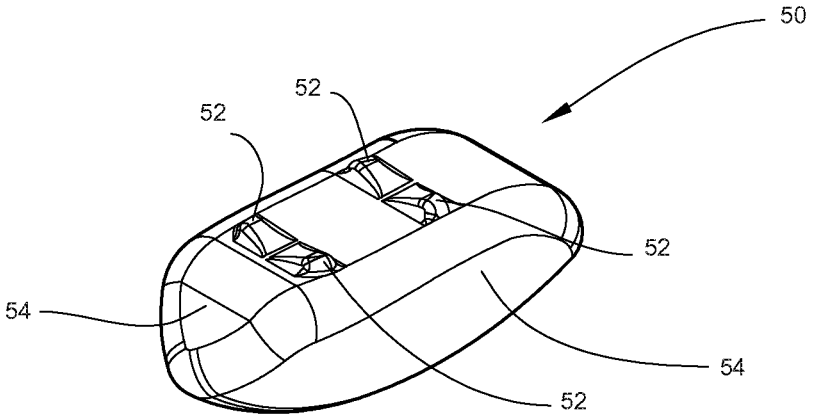
FIG. 13E is a perspective view of a further embodiment of a damping unit shown in FIG. 13A.
Figure 13F:
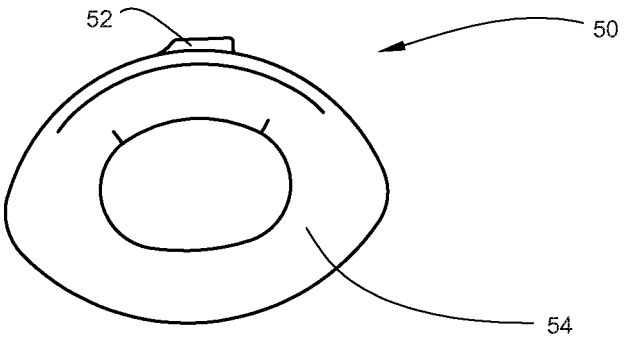
FIG. 13F is an elevational view of an alternative embodiment of a damping unit shown in FIG. 13A.
Figure 13G:
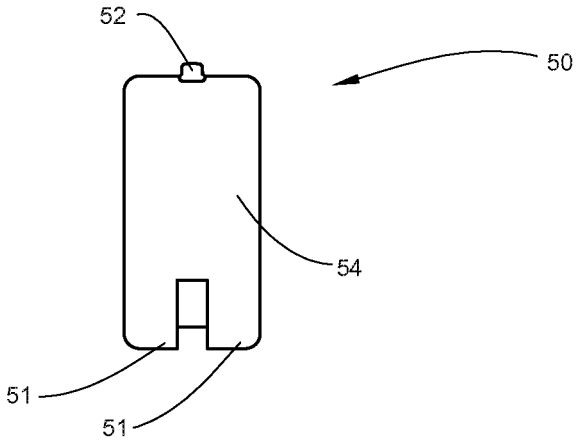
FIG. 13G is a front view of the embodiment of the damping unit shown in FIG. 13F.
Figure 13H:
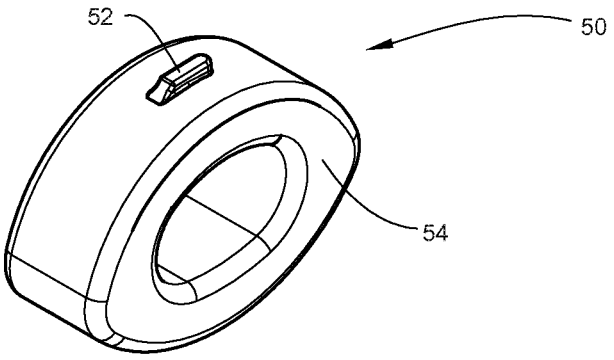
FIG. 13H is a perspective view of the embodiment of the damping unit shown in FIG. 13F.
Figure 13I:
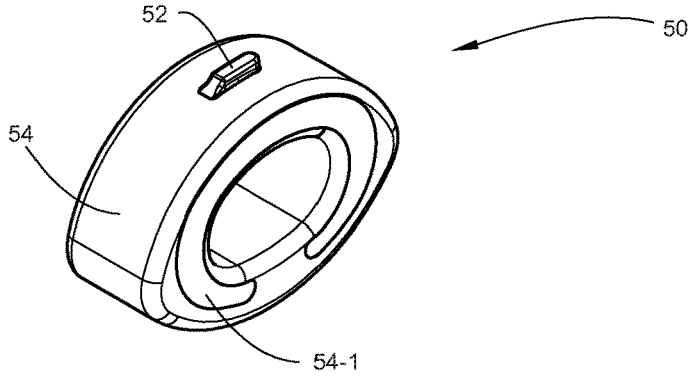
FIG. 13I is a perspective view of an alternative embodiment of the damping unit shown in FIG. 13F.
Figure 13J:
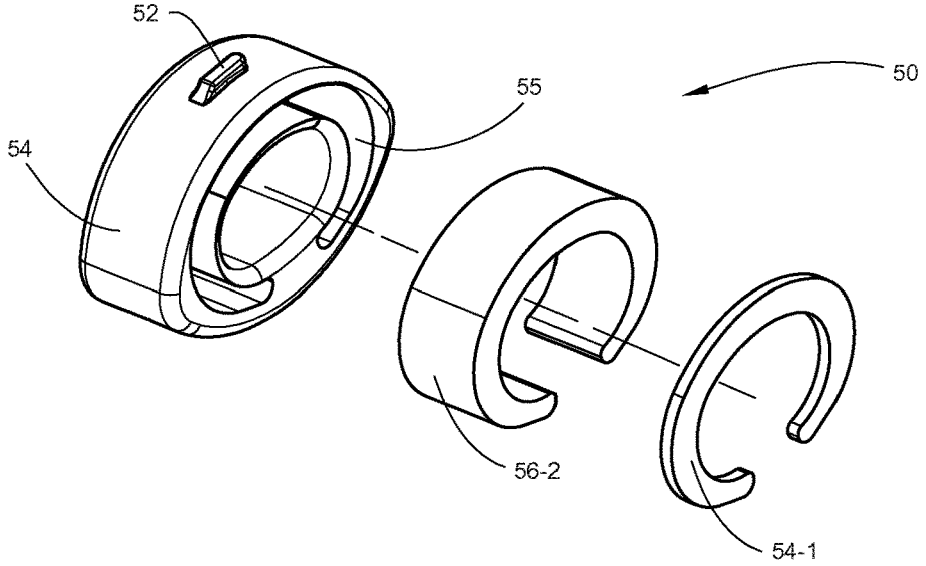
FIG. 13J is an exploded perspective view of the embodiment of the damping unit shown in FIG. 13I.
Figure 13K:
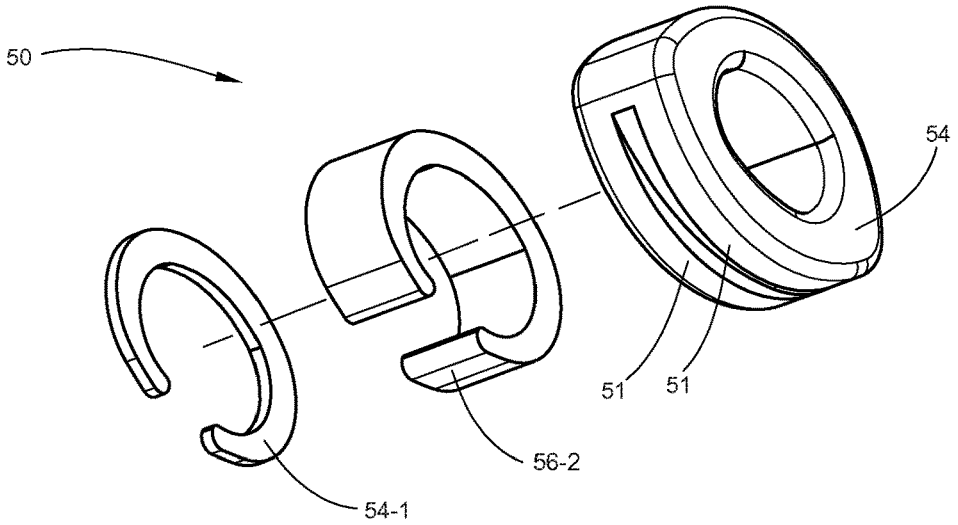
FIG. 13K is a further exploded perspective view of the embodiment of the damping unit shown in FIG. 13I, as regarded from different angle as compared with the FIG. mentioned above.
Figure 13L:
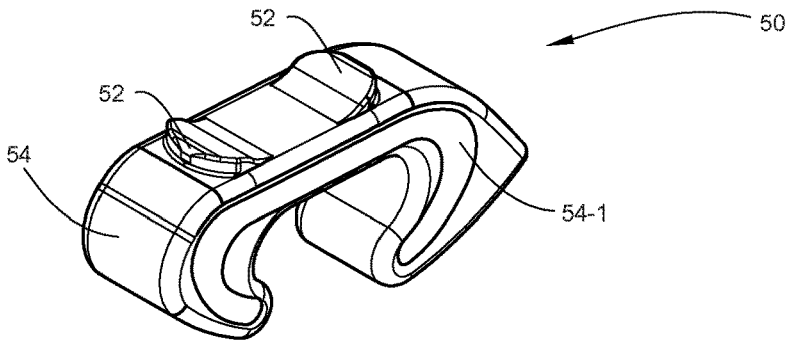
FIG. 13L is a perspective view of an alternative embodiment of the damping unit shown in FIG. 13I.
Figure 13M:
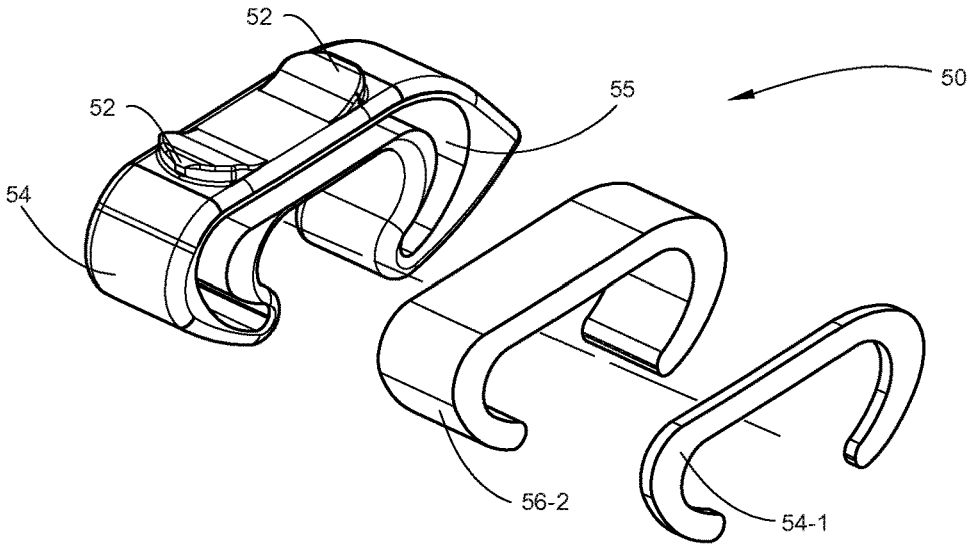
FIG. 13M is an exploded perspective view of the embodiment of the damping unit shown in FIG. 13L.
Figure 13N:
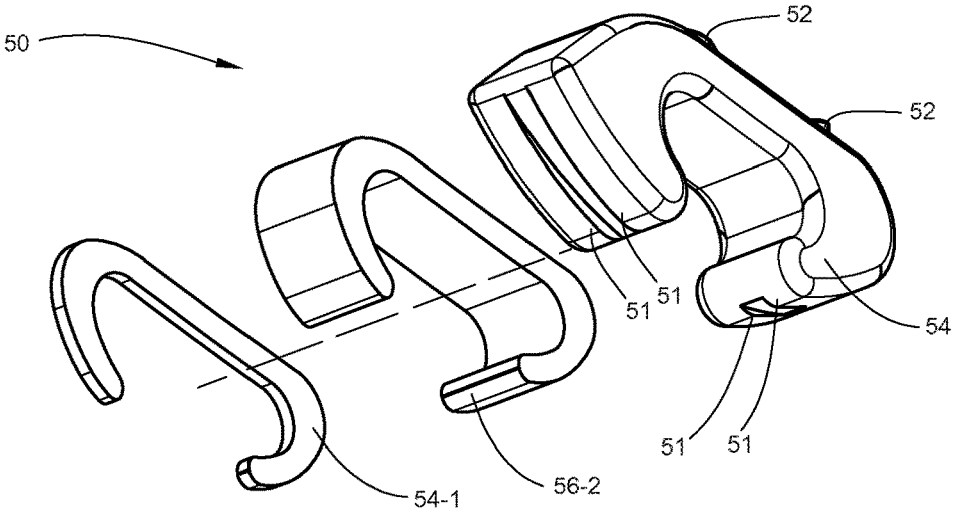
FIG. 13N is a further exploded perspective view of the embodiment of the damping unit shown in FIG. 13L, as regarded from different angle as compared with the figure mentioned above.
Figure 13O:
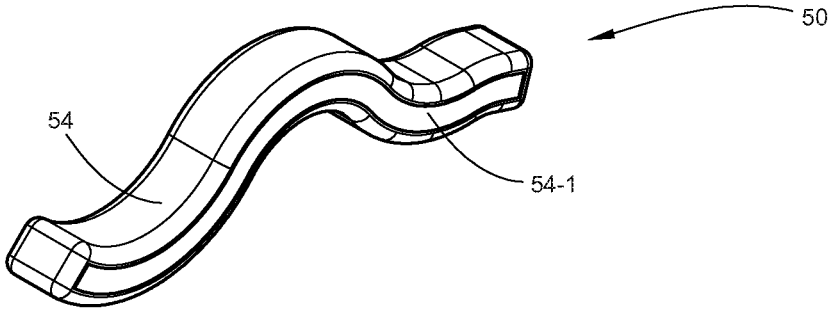
FIG. 13O is a perspective view of an alternative embodiment of the damping unit shown in FIG. 13L.
Figure 13P:
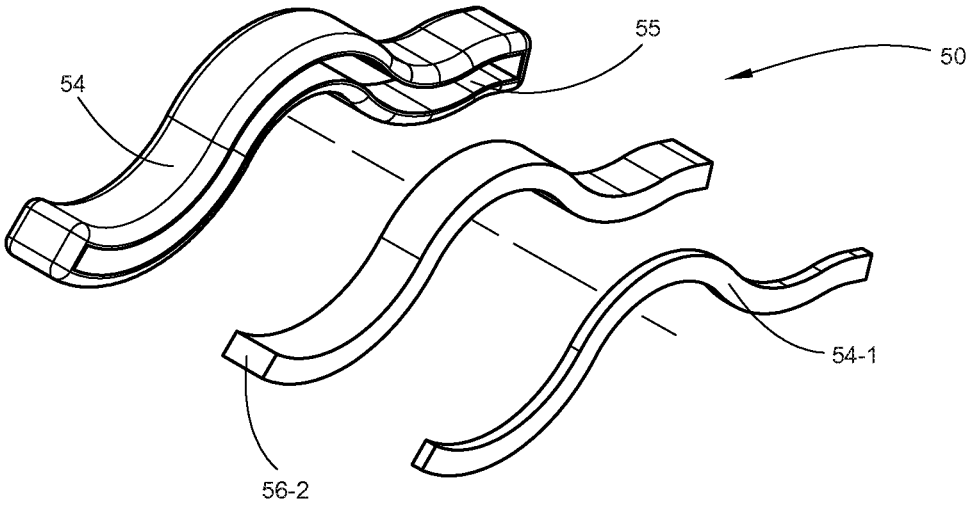
FIG. 13P is an exploded perspective view of the embodiment of the damping unit shown in FIG. 13O.
Figure 13Q:
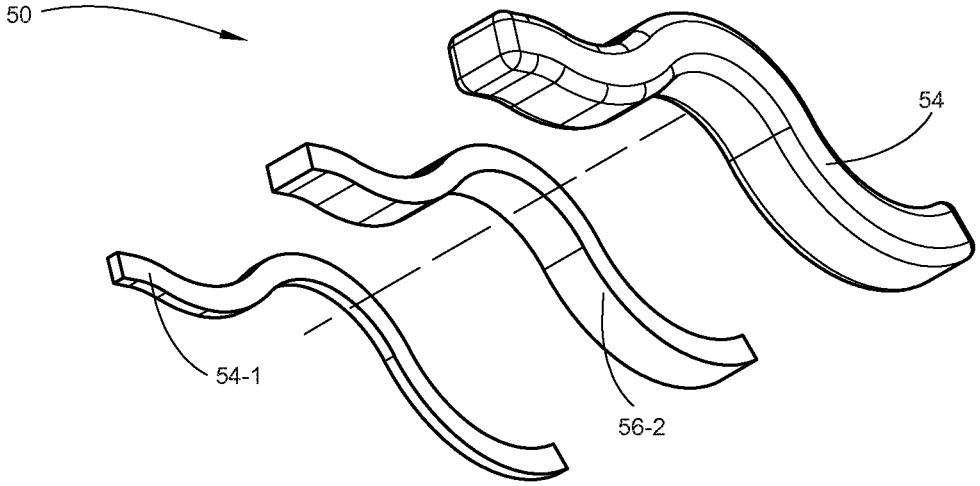
FIG. 13Q is a further exploded perspective view of the embodiment of the damping unit shown in FIG. 13O, as regarded from different angle as compared with the figure mentioned above.

The lower portion of the damping unit 50 generally has a curved longitudinal profile that enables to secure the blade runner 70-1 or 70-2 within the frame 40 in the forward-rearward longitudinal axis (X) and vertical axis (Y) relative to the frame 40, as shown in FIGS. 13A-13Q. In an alternative embodiment, the damping unit 50 consists of two straight portions angled relative to each other, securing the blade runner 70-1 or 70-2 in the forward-rearward longitudinal axis (X) and vertical axis (Y) relative to the frame 40. In an alternative embodiment, the damping unit 50 may consist of separated parts, one securing the blade runner 70-1 or 70-2 in the forward-rearward longitudinal axis (X) and the other part in the vertical axis (Y) relative to the frame 40.

The damping unit 50 can be secured within the frame 40 by various methods, such as but not limited to, a frame 40 covering the damping unit 50 laterally from the sides, a fastening member securing the damping unit 50 within the frame 40, a damping unit 50 glued to the frame 40 or a damping unit 50 having a rounded top side that fits into a corresponding rounded top inside of the frame 40. In an example shown in FIGS. 13A-13D, a groove 53-1 or 53-2 is located on the top side of the damping unit 50. The groove 53-1 is configured to fit in a protrusion 28 extending downwards from the top inside surface of the frames 20 and 60 of the first embodiment, best shown in FIG. 4. The damping unit 50 having a groove 53-2 can secure its position relative to the heads of fastening members (not shown) traveling through holes 9 in the mounting plates 22 for attaching the frame 40 to the sole of the skate boot 100. The damping unit 50 may also comprise protrusions 52 extending from its top portion, to secures the position of the damping unit 50 relative to an aperture 19 in the mounting plate 22 of the frame 40, according to an embodiment best shown in FIG. 10. The protrusions 52 and the aperture 19 can be of various shapes, such as but not limited to the protrusions 52 shown in FIGS. 13F-13J, 13L and 13M. The damping unit 50 may also secure its position relative to the blade runner 70. The damping unit 50, according to an embodiment best shown in FIGS. 2, 3, 13A-13C, 13G, 13K and 13N, covers a small portion of the blade runner 70 from sides in transversal axis relative to the blade runner 70, by projecting portions 51 extending downwards from the front bottom surface of the damping unit 50. The projecting portions 51 of the damping unit 50 are spaced in transversal axis according to the thickness of the blade runner 70. In an alternative embodiment, the blade runner 70-1 or 70-2 may fit by at least a portion into the damping unit 50, or the damping unit 50 may fit by at least a portion into the blade runner 70-1 or 70-2. In an alternative embodiment, the supporting part 63 placed between the blade runner 70-1 or 70-2 and the damping unit 50 secures the position of the parts, where the upper portion of the supporting part 63, where it is to be in contact with the damping unit 50, has a matching shape 66 to the longitudinal profile as well as to the lower portion of the damping unit 50, as shown in FIG. 9-11. The supporting part 63 may affect the stiffness of the damping, for example by increasing the contact area with the damping unit 50, or by allowing for use of a wider damping unit 50.

The damping unit 50 used in the modular damping ice-skating blade assembly 90 may consist of one part of one material, or of several parts and materials, wherein the damping unit 50 reacts flexibly to the load caused by the effects of the landing impact. The flexible response of the damping unit 50 to the compressive load transmitted from the blade runner 70-1 or 70-2 during landing impacts, such as displacement and compression, depends on the material properties and the construction of the damping unit 50. According to an embodiment, the damping unit 50 consists of an elastic body 54 made of an elastomeric material. According to a further embodiment, the elastic body 54 may be an air-filled inflatable bag. The elastic body 54 can be of various shapes, such as but not limited to a cylindrical shape and a curved longitudinal profile, shown in FIGS. 1-4, 6, 7, 9-12 and 13A-13E. According to an embodiment, the elastic body 54 may be of a ring shape, shown in FIGS. 13F-13K, or an open oval ring shape, shown in FIGS. 13L-13N, or of a recurved bow shape, shown in FIGS. 13O-13Q. According to an embodiment best shown in FIGS. 13A and 13D, the elastic body 54 of the damping unit 50 includes a cavity 55 extending longitudinally along the entire length of the elastic body 54. In an alternative embodiment, the cavity 55 in the elastic body 54 may be extending transversally to the longitudinal axis (X), as shown in FIGS. 13J, 13M and 13P. The cavity 55 in the elastic body 54 is intended to affect the stiffness and the flexible response of the damping unit 50 to the compressive load. The cavity 55 may remain empty to reduce the stiffness of the damping unit 50, or a reinforcing part, such as an infill 56-1 or a spring 56-2, may be inserted into the cavity 55 to increase the stiffness of the damping unit 50. The cavity 55 may be of various shapes and sizes and may not have to extend along the entire length or thickness of the elastic body 54. In an alternative embodiment, several cavities may be included in the elastic body 54. According to an embodiment shown in FIG. 13C, the damping unit 50 consists of two separable parts, the elastic body 54 and the infill 56-1 placed inside the cavity 55. In this example, the elastic body 54 and the infill 56-1 are made of thermoplastic polyurethane (TPU) of different A Shore hardness. According to an embodiment shown in FIGS. 13I-13Q, the damping unit 50 consists of three separable parts, the elastic body 54, the spring 56-2 placed inside the cavity 55 of the elastic body 54 and a side part of the elastic body 54-1 enclosing the spring 56-2 inside the elastic body 54. The side part of the elastic body 54-1 is configured to fit into the elastic body 54 and may be adhered to it. In these examples, the elastic body 54 and the side part of the elastic body 54-1 are made of elastomeric material such as, but not limited to, TPU or rubber, and the spring 56-2 is formed of a stiff elastic material such as, but not limited to, spring steel, polymer materials or composite materials. The spring 56-2 can be of a leaf spring design or a coil spring design and in various combination with the elastic body 54 of elastomeric material. In an alternative embodiment, the spring 56-2 may be used without the elastic body 54.

The damping unit 50 is subjected to great compressive loading repeatedly in a cold humid environment of ice rinks. The landing impacts from figure skating jumps can be greater than five times the body weight of a skater, all being transferred to the damping units 50 of just one modular damping ice-skating blade assembly 90 configured for 2DOF or 1DOF damping. The elastomeric material suitable for this purpose is of Shore A hardness 60-100, with high impact resilience, excellent cold resistance and low compression set, such as, but not limited to, polycyclopentene rubber (CPR) and versions of thermoplastic polyurethane (TPU) such as 1195 A 15 and C 85 A 10 from Elastollan® TPU. The damping units 50 in the examples shown in FIGS. 13A-13E, are 3D printed from TPU 90A. A tested version of the 3D printed damping unit 50 resisted compressive load of 5000 N with 5 millimeters displacement making it suitable for great landing impacts, for skaters weighing around 70 Kilograms. Damping units 50 of different stiffnesses are intended for skaters of different weight categories, generally limited by the displacement of the damping unit 50 being less than one millimeter under a load of two times the body weight of a skater. A tested version of the 3D printed damping unit 50 displaced 1 millimeter under compressive load of 1500 N, making it a suitable version of the damping unit 50 for skaters weighing around 70 Kilograms. A stiffer version of the damping unit 50 can be placed in the front section of the frame 40 and softer in the rear section of the frame 40.

—Bumpers—

The frame 40 of the modular damping ice-skating blade assembly 90, in configuration for 2DOF or 1DOF damping, may include bumpers 10 extending downwards from the top inside wall of the frame 40, in line with the blade runner 70, protecting the frame 40 from possible impacts of the blade runner 70 during its movement inside the frame 40. The bumpers 10 may also be used to limit the displacement of the damping unit 50 by stopping the blade runner 70 at a specific distance from the frame 40. The bumpers 10 may also be used as additional cushioning for the blade runner 70, to improve the impact damping. The bumpers 10, according to the first embodiment best shown in FIGS. 1-4, 6 and 7, are placed in the frames 20 and 60 on locations where possible impacts of the blade runner 70 to the frame 40 may occur, generally where the top portion of the blade runner 70 has the closest vertical distance to the top inside wall of the frame 40. The bumpers 10, in this example, include protrusions 11 extending upwards from the top surface of the bumpers 10 configured to fit and hold in grooves 29 located in the top inside wall of the frames 20 and 60. In an alternative embodiment, the bumpers 10 may be glued to the frame 40 or may be an integral part of the damping unit 50.

The invention is not limited to the embodiments but can be varied within the scope of the appended claims.

The invention claimed is:

1. A configurable modular damping ice-skating blade assembly comprising:

a frame comprising a plurality of protruding arms;

a blade runner removably mounted in relation to the frame and extending along a longitudinal axis, the blade runner being one of a plurality of modified blade runners configured to be received in the frame; and at least one damp device disposed in the frame to dampen a movement of the frame in relation to the blade runner, the at least one damping device being located between the protruding arms of the frame, the protruding arms being configured to secure the damping device in the longitudinal axis relative to the frame, wherein the configurable modular damping ice-skating blade assembly is configurable with each of the plurality of modified blade runners to damp movement of the frame in relation to the blade runner.

2. The assembly according to claim 1, wherein the at least one damping device is disposed in said frame with a configuration to allow said blade runner to move in a flexible manner in said frame along the longitudinal axis and along a vertical axis which is perpendicular to said longitudinal axis, to provide damping in two degrees of freedom.

3. The assembly according to claim 2, wherein said blade runner is rigidly mounted in relation to said frame creating a rigid configuration substantially without damping.

4. The assembly according to claim 2, wherein said blade runner is provided with at least one large transversally extending aperture allowing the blade runner to be attached to said frame, or said blade runner is provided with at least one large transversally extending aperture and one generally circular through-hole allowing the blade runner to be attached to said frame, said through-hole being configured to pivotally couple with the frame, or said blade runner is provided with at least two generally circular through-holes allowing the blade runner to be attached to said frame creating a rigid construction.

5. The assembly according to claim 4, wherein the blade runner is attached to the frame by a transversal bearer extending through said large transversally extending aperture or said circular through-hole.

6. The assembly according to claim 5, wherein the large transversally extending aperture allows movement of the blade runner upwards to different angles in the forward-rearward longitudinal axis, the vertical axis and along an axis of rotation relative to the frame without interfering with said transversal bearer that passes through the large transversally extending aperture.

7. The assembly according to claim 5, wherein said transversal bearer is configured as a pin with a screw hole and a screw located in said screw hole, to create a counter-force mechanism enabling to adjust the fit and preloading force between the blade runner and the at least one damping device by screwing said screw from said pin against said blade runner which shifts said blade runner upwards in the direction of said at least one damping device.

8. The assembly according to claim 1, wherein said blade runner is pivotally coupled in relation to said frame in a configuration to move in a flexible manner in said frame along an axis of rotation, which is transverse to said longitudinal axis, so as to provide damping in one degree of freedom.

9. The assembly according to claim 1, wherein said at least one damping device has a curved longitudinal profile that enables the blade runner to be secured within the frame in the forward-rearward longitudinal axis and vertical axis relative to the frame.

10. The assembly according to claim 1, wherein the frame comprises a front-frame portion and a back-frame portion, and wherein a first damping device of the at least one damping device is located between protruding arms in the front-frame portion and a second damping device of the at least one damping device is located between protruding arms in the back-frame portion.

11. The assembly according to claim 1, wherein said at least one damping device is provided with a protrusion extending from a top portion thereof to secure a position of the at least one damping device within the frame, said protrusion being configured to fit in an aperture in said frame.

12. The assembly according to claim 1, wherein said at least one damping device is configured as an elastic body with a cavity.

13. The assembly according to claim 12, wherein said at least one damping device comprises an infill or a spring which is accommodated within said cavity in the elastic body, to reinforce the at least one damping device.

14. The assembly according to claim 1, wherein the frame comprises a plurality of bumpers extending downwards from a top inside wall of said frame and in line with the blade runner, the plurality of bumpers being configured to protect the frame from impacts of the blade runner during movement of the blade runner inside the frame.

15. The assembly according to claim 1, wherein said frame constitutes an integral part of a sole of an ice-skating boot.

16. The assembly according to claim 1, wherein the at least one damping device is one of a plurality of damping devices of different stiffnesses for skaters of different weight categories, limited by displacement of the at least one damping device being less than one millimeter under a load of two times the body weight of a skater.

17. The assembly according to claim 1, wherein the protruding arms of the frame are joined to form an opening configured to accommodate the at least one damping device.

18. The assembly according to claim 1, wherein the protruding arms of the frame are configured to allow lateral displacements of the at least one damping device when a compressive load is transmitted to the at least one damping device.

19. A configurable modular damping ice-skating blade assembly comprising:

a frame comprising a plurality of protruding arms;

a blade runner being removably mounted in relation to the frame and extending along a forward-rearward longitudinal axis, the blade runner being one of a plurality of blade runners configured to be received in the frame, the blade runner being configured to attach to the frame by a transversal bearer configured to pass through an aperture in the blade runner; and at least one damping device disposed in said frame to allow one or more configurations to damp the frame in relation to the blade runner, the at least one damping device located between the protruding arms of the frame, the protruding arms being configured to secure the at least one damping device in the forward-rearward longitudinal axis relative to the frame, wherein the transversal bearer is configured to enable adjustment of a fit and preloading force between the blade runner and the at least one damping device.

20. A configurable modular ice-skating blade assembly comprising:

a frame comprising a plurality of protruding arms;

a blade runner extending along a forward-rearward longitudinal axis, the blade runner being configured to attach to the frame, the blade runner being one of a plurality of blade runners configured to be attached to the frame; and at least one resilient system disposed in said frame allow one or more configurations to mitigate load, shocks, and vibrations transmitted to the frame in relation to the blade runner, the at least one resilient system being disposed between the protruding arms of the frame, the protruding arms being configured to secure the at least one resilient system in the forward-rearward longitudinal axis relative to the frame.

* * * * *